US006736078B2

(12) United States Patent
Kaetterhenry et al.

(10) Patent No.: US 6,736,078 B2
(45) Date of Patent: May 18, 2004

(54) SOFT GOODS SLITTER AND FEED SYSTEM FOR QUILTING

(75) Inventors: Jeff Kaetterhenry, Davie, FL (US); Richard Villacis, Miami, FL (US)

(73) Assignee: L&P Property Management Company, South Gate, CA (US)

( * ) Notice: Subject to any disclaimer, the term of this patent is extended or adjusted under 35 U.S.C. 154(b) by 148 days.

(21) Appl. No.: 10/087,467

(22) Filed: Mar. 1, 2002

(65) Prior Publication Data

US 2003/0164129 A1 Sep. 4, 2003

(51) Int. Cl.[7] ..... D05B 27/10; D05B 37/08
(52) U.S. Cl. ..... 112/475.08; 112/304; 112/122.3
(58) Field of Search ..... 112/475.08, 475.03, 112/303, 304, 305, 306, 307, 318, 322, 122, 117, 122.7, 122.4, 130, 220; 30/102; 83/331, 339, 344, 345, 37, 86, 348, 731, 492, 496, 497, 502

(56) References Cited

U.S. PATENT DOCUMENTS 285,896 A * 10/1883 Beardslee ..... 72/467
2,803,206 A * 8/1957 Solow ..... 112/122.3
3,143,024 A * 8/1964 Markowsi ..... 83/497
3,682,032 A * 8/1972 Pfeiffer ..... 83/496
3,869,999 A * 3/1975 Richter ..... 112/470.32
4,594,955 A * 6/1986 Lichtenberg ..... 112/147

* cited by examiner

*Primary Examiner*—Ismael Izaguirre
(74) *Attorney, Agent, or Firm*—Wood, Herron & Evans, L.L.P.

(57) ABSTRACT

An apparatus is provided for feeding and slitting mattress covers, quilts and other soft goods supported on a table. The apparatus has a first slitting wheel rotatable by a motor. A second slitting wheel is rotatable by the motor and contacts the first slitting wheel to provide a cutting action. The apparatus further includes upper and lower conveyors operable by the motor for conveying the soft goods past the slitting wheels. The upper conveyor is resiliently vertically movable and applies a compression force against the soft goods as they are moved between the upper and lower conveyors and past the slitting wheels.

21 Claims, 4 Drawing Sheets

SOFT GOODS SLITTER AND FEED SYSTEM FOR QUILTING

FIELD OF THE INVENTION

This invention relates generally to cutting flat soft goods and more particularly, to feeding and cutting a stack comprised of different layers of soft goods. The invention is particularly useful for trimming the longitudinal edges of mattress covers and other quilted soft goods in large-scale, wide-width quilt manufacturer.

BACKGROUND OF THE INVENTION

In the manufacture of bedding and furniture, a mattress cover or other cushion is often fabricated from layers of different soft goods. Such mattress covers are typically made on wide-width multi-needle quilting machines and associated panel cutters such as those described in U.S. Pat. Nos. 5,154,130, 5,544,599 and 6,237,517, all hereby expressly incorporated by reference herein.

For example, a mattress cover is often comprised of a stack of layers of different soft goods, which are often quilted together, that include a first, top layer of fabric ticking material, a second layer of a fiber material, a third layer of foam and a bottom layer of fabric backing material. Such a stack of compressible soft goods is about 2–6 inches thick and has a length and width corresponding to the size of the mattress cover being made. As part of the manufacturing process, it is necessary that the edges of the stack of soft goods be trimmed, so that the edges are straight and parallel. Known edge cutting machines have a motor-driven conveyor belt that transfers the stack of soft goods past a motor-driven compression roller and a pair of motor-driven cutting wheels. The compression roller compresses the stack of soft goods to a thickness of less than about three inches. A motor-driven cutting wheel is located on each side of the machine, and the cutting wheels must have a radius greater than the thickness of the compressed stack of soft goods, that is, at least about three inches.

While such a cutting operation is effective, it does have some disadvantages. First, the cutting wheel is relatively thin and has a tendency to bend or warp slightly from the cutting forces applied by the compressed stack of soft goods being moved past the cutting wheel by the conveyor. Thus, the cutting wheel has a tendency to drift or walk with respect to a desired straight cutting path, thereby producing a cut edge of the stack of soft goods that is rough and not straight over the length of the stack.

Second, the cutting wheel edge dulls with use and must be periodically sharpened. Therefore, a separate sharpening device is mounted adjacent the cutting wheel. In order to effect a sharpening cycle, the edge cutting operation is interrupted; and the sharpening device is manually or automatically moved into contact with the cutting wheel to execute a cutting wheel sharpening cycle. During the sharpening cycle, the cutting machine is out of production; and thus, the sharpening cycle reduces the efficiency of the machine operation and adds to the overall cost of the cutting operation.

In addition, the overall structure of the cutting machine is relatively complicated and costly. The cutting machine requires a motor-driven compression roller as well as a relatively wide motor-driven conveyor belt that provides a subjacent support for the stack of soft goods and moves it past the cutting wheel. A sharpener is also required, which has actuators that move the sharpener into contact with the cutting wheel; and often, a separate clamp is used. Such a system has different motors or actuators for powering the cutting wheel, the compression roller, the conveyor and for positioning the cutting wheel sharpener. Further, the operation of those actuators is often coordinated by a separate control. Such a complex cutting machine is expensive to build, operate and maintain; and that expense must be borne by the product, for example, the mattress cover, being trimmed on the cutting machine. This is particularly relevant to quilt manufacture.

Therefore, there is a need for a cutting machine that reliably provides a clean and straight cut edge over the full length of the stack of soft goods and that has a simpler and less costly structure. This need especially exists in the manufacture of quilts such as quilted mattress covers, that are manufactured on a large-scale.

SUMMARY OF THE INVENTION

The present invention provides a relatively compact and inexpensive slitter and feed mechanism that reliably feeds, compresses and cuts side edges of a quilt or other stack of soft goods.

According to certain embodiments of the invention, the slitter and feed mechanism achieves the feeding, compression and cutting actions with just a single motor. The use of only one motor represents a substantial cost savings over known feeding, compressing and cutting devices. A quilting panel cutter equipped with such a slitter and feed mechanism improves the quality and economy of the quilt making process.

According to other aspects of the invention, the slitter and feed mechanism further permits the compression force to be easily adjusted. The cutting edges of the slitting wheels are preloaded to more reliably hold the cutting edges in contact, so that a clean and consistent cutting action is provided. As a result, in a quilt manufacturing operation, quilts of differing thicknesses can be trimmed without the need for prolonged shutdown and adjustment of the quilting line.

In addition, with the slitter and feed mechanism of the present invention, the slitting wheels are mounted to be self-sharpening during use, thereby providing a more reliable cutting action over an extended period of time. Thus, the slitting process is more efficient because the machine does not have to be taken out of production to sharpen the slitting wheels. The slitter and feed mechanism of the present invention is especially useful in the textile industry for trimming a quilt or other stack of soft goods as is found, for example, in a cushion or mattress cover.

According to the principles of the present invention and in accordance with the described embodiments, the invention provides an apparatus for feeding and slitting soft goods such as a mattress cover or other quilt being supported on a table. The apparatus has a motor mounted on a frame and a first slitting wheel rotatable by the motor. A second slitting wheel is rotatable by the motor and contacts the first slitting wheel to provide a cutting action. Thus, both of the slitting wheels are rotatable by a single motor.

In one aspect of this invention, the apparatus further includes a conveying apparatus for conveying the soft goods past the slitting wheels; and the conveying apparatus is operably connected to the motor. Thus, the single motor not only operates the slitting wheels but also operates the conveying apparatus.

In another embodiment of the invention, an apparatus for slitting and feeding soft goods includes first and second slitting wheels that are rotatable by a motor. A biasing apparatus is mechanically connected to the first slitting wheel and biases the first slitting wheel against the second slitting wheel with a desired biasing force. Such a biasing forces maintains the first and second slitting wheels in contact during a cutting operation.

In a further embodiment of the invention, an apparatus for slitting and feeding soft goods includes first and second slitting wheels that are rotatable by a motor about respective first and second axes of rotation. The second axis of rotation is oblique to the first axis of rotation by an amount that results in a self-sharpening of the slitting wheels. In one aspect of the invention, the oblique axes of motion form an acute angle therebetween of about 2°. The oblique axes of rotation plus the slitting wheel biasing force provides a self-sharpening capability that substantially improves the durability, quality and reliability of the cutting action of the slitting wheels.

In yet another embodiment of the invention, an apparatus for slitting and feeding soft goods includes first and second slitting wheels that are rotatable by a motor. A powered lower conveyor contacts and supports a lower surface along an edge of the soft goods; and a powered upper conveyor contacts an upper surface along the edge of the soft goods. The upper conveyor has an upper conveyor belt with a belt portion resiliently movable in a generally vertical direction with respect to the lower conveyor. The upper conveyor is thus able to provide a downward acting compression force against the soft goods. In further aspects of this invention, the compression force is adjustable; and the conveyors are powered by the slitting wheel motor.

In a still further embodiment of the invention, an apparatus for feeding and slitting compressible soft goods has a stationary table for supporting the soft goods. A rail is disposed above, and extends across a width of, the stationary table. First and second slitter and feed mechanisms are mounted on the rail adjacent side edges of the table. The slitter and feed mechanisms are movable across the width of the table. A first actuator is mounted on the rail and has a reciprocable drive shaft pivotally connected to the first slitter and feed mechanism, and a second actuator is mounted on the rail and has a reciprocable drive shaft pivotally connected to the second slitter and feed mechanism. Thus, the separation of the slitter and feed mechanisms can be controlled to trim different widths of soft goods.

These and other objects and advantages of the present invention will become more readily apparent during the following detailed description taken in conjunction with the drawings herein.

DETAILED DESCRIPTION OF THE INVENTION

Figure 1:
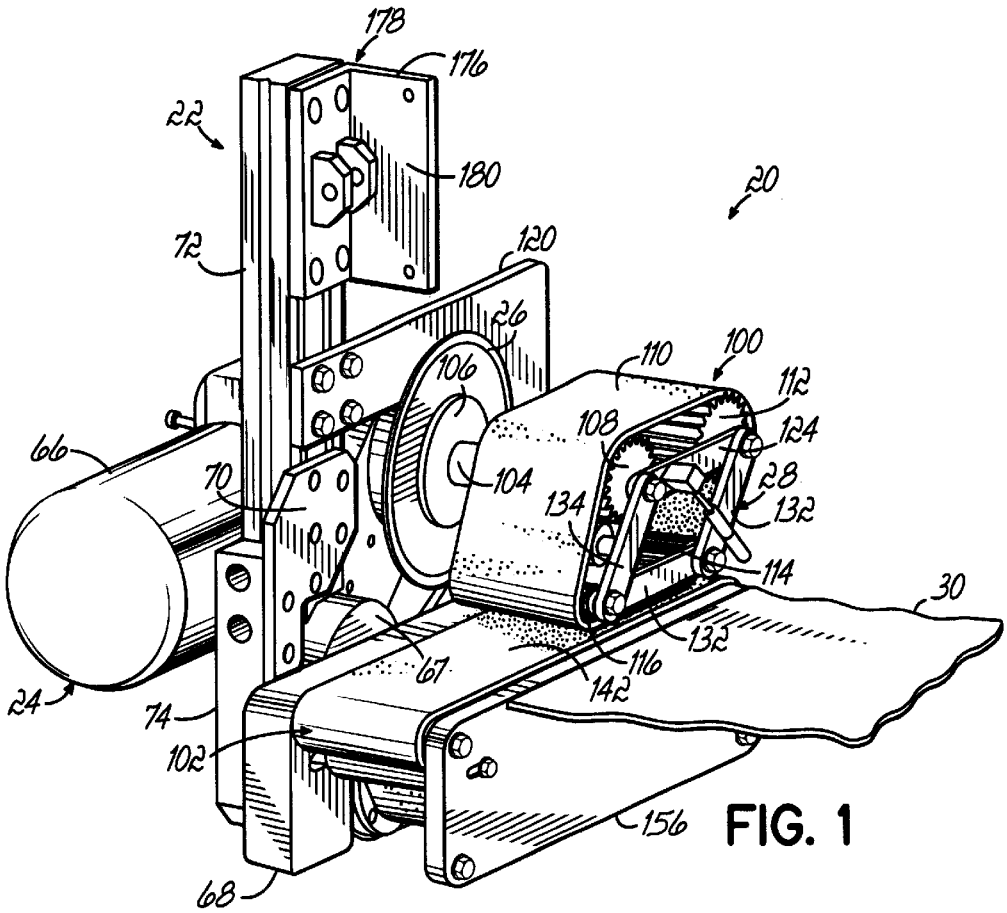
FIG. 1 is a perspective view of a slitter and feeder mechanism in accordance with the principles of the present invention, which is used to trim one edge of soft goods.
Figures 2, 4:
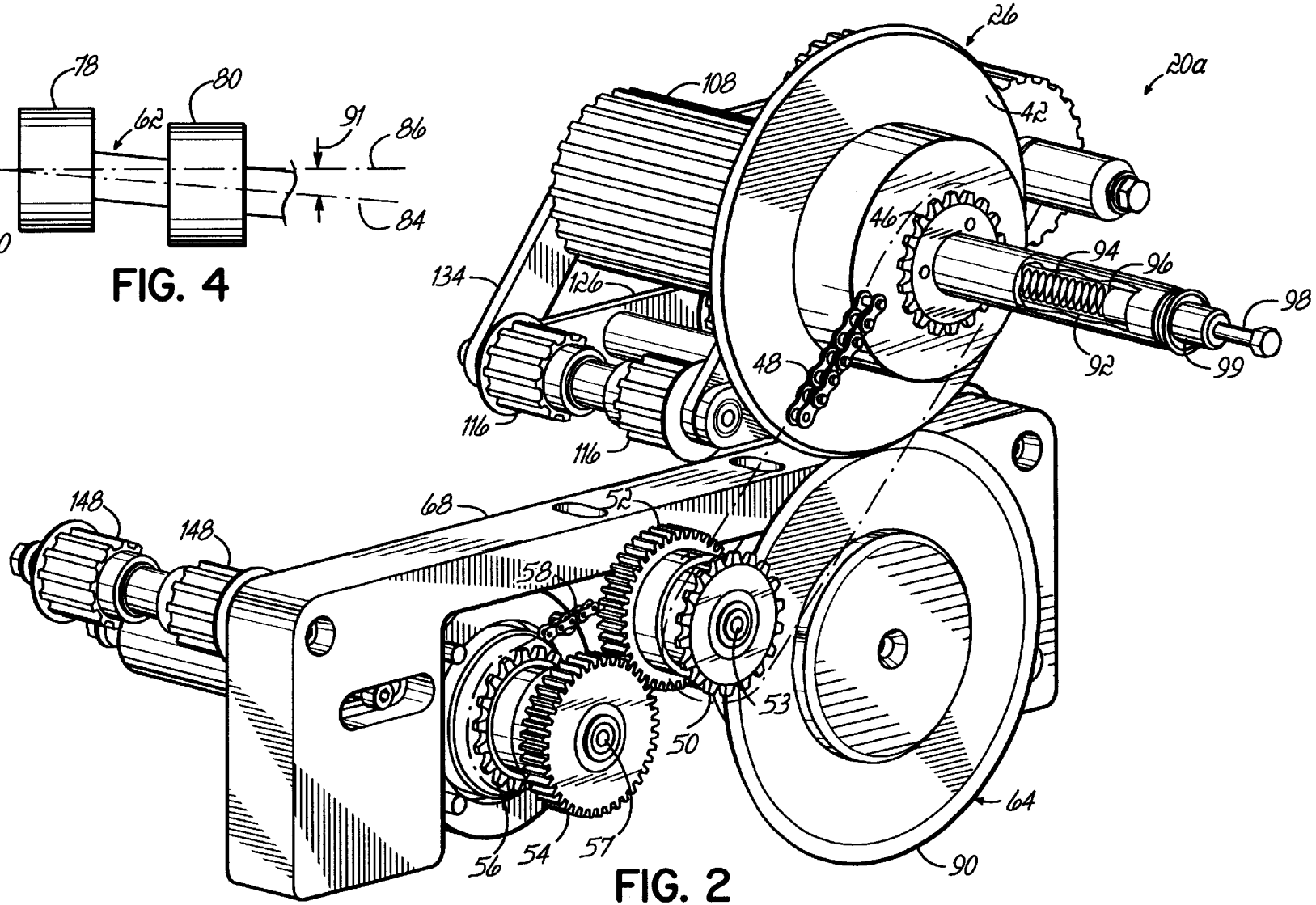
FIG. 2 is a partial perspective view of a slitter wheel power drive for a slitter and feed mechanism that is a mirror image of, but otherwise identical to, the slitter and feed mechanism shown in FIG. 1.
FIG. 4 is a top view of spindle bearings for one of the slitter wheels and illustrate an oblique relationship between axes of rotation of the slitting wheels used with the slitter and feed mechanism of FIG. 1.
Figure 3:
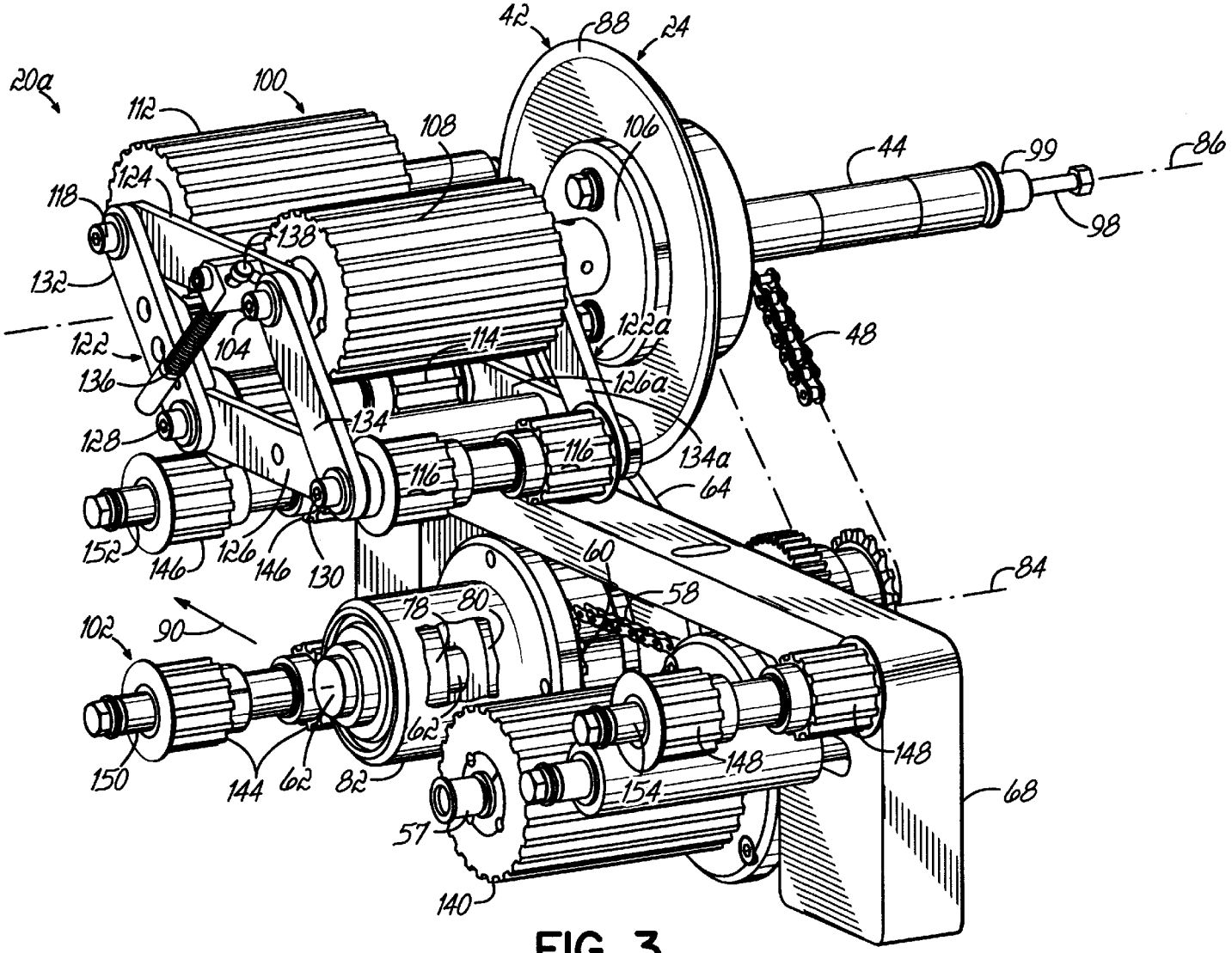
FIG. 3 is a partial perspective view of a conveyor drive of the slitter and feed mechanism that is a mirror image of, but otherwise identical to, the slitter and feed mechanism shown in FIG. 1. and which is used to trim an opposite edge of the soft goods. for a slitter and feed mechanism

Referring to FIG. 1, a slitter and feed mechanism 20 is mounted on one side of a table 158 (FIG. 5) and is used to trim one edge of soft goods 32. Referring to FIG. 1, a slitter and feed mechanism 20 is generally comprised of a support frame 22, an actuator 24, for example, an electric motor, a slitter 26 and a conveyor 28. The motor 24 and gearbox 66 are packaged together as a ⅓ horsepower, 67 rpm, face-mount, gear motor, part no. #SK1S50AZ-71S/4, commercially available from Gateway Textiles of Notts, England. Referring to FIGS. 2 and 3, a slitter and feed mechanism **20*a* is mounted on an opposite side of a table 158 (FIG. 5) and used to trim an opposite edge of soft goods 32. Thus, the slitter and feed mechanism 20*a* is a mirror image of, but otherwise identical to, the slitter and feed mechanism 20. The slitter 26 has an upper cutting or slitting wheel 42 mounted on one end of a spindle 44. The opposite end of the spindle 44 has a keyway (not shown), so that it can be axially engaged in a drive shaft (not shown) in the gear box 66 (FIG. 1) in a known manner. A first upper sprocket 46 is rigidly mounted on the upper spindle 44 and engages an upper drive chain 48. The upper drive chain 48 is connected to a second upper sprocket 50 that is welded or otherwise rigidly attached to an upper pinion gear 52. The second upper sprocket 50 and upper pinion gear 52 are mounted on an upper axle 53. The upper pinion gear 52 mechanically engages a lower pinion gear 54 that is welded or otherwise rigidly connected to a first lower sprocket 56. The first lower sprocket 56 and lower pinion gear 54 are mounted on a lower axle 57. The first lower sprocket 56 mechanically engages a chain 58 that is also mechanically engaged with a second lower sprocket 60. The second lower sprocket 60 is mounted on a lower spindle 62 that supports a lower cutting or slitting wheel 64. The slitting wheels 42, 64** are blade, scissor, small bevel slitting wheels commercially available from Gateway Textiles of Notts, England.

The upper and lower axles 53, 57 are supported at their ends within a drive housing 67 (FIG. 1) that is configured to cover the sprockets 46, 50, 56, 60 and gears 52, 54. The motor 24 and gear box 66 are mounted to the drive housing 67 by fasteners or other means, and the drive housing 67, in turn, is mounted to an inner shaft support 68. The frame 22 includes a front plate 70, an extrusion 72 and a spacer 74 all of which are connected together by fasteners or other means. The front plate 70 and spacer 74 facilitate the connection or fastening of the extrusion 72 with the inner shaft support 68. The inner shaft support 68 is rigidly connected to an outer shaft support 69 by tie bars (not shown) that are fastened at their ends to the shaft supports 68, 69. A support plate 30 is rigidly fastened to the to the outer shaft support 69.

The motor 24 thus provides power to the upper and lower slitting wheels 42, 64. Further, the diameters of the sprockets 46, 50, 56, 60 and the pinion gears 52, 54 are chosen such that the angular velocity of the upper slitting wheel 42 is substantially equal to the angular velocity of the lower slitting wheel 64.

As shown in FIG. 3, the lower spindle 62 is supported by an outer bearing 78 and an inner bearing 80 that are mounted inside a bearing housing 82. Typically, the bearings 78, 80 are oriented such that the lower spindle 62 has a lower axis of rotation 84 that is substantially parallel to an upper axis of rotation 86 of the upper spindle 44. Therefore, referring to FIG. 4, looking down on the bearings 78, 80, with a typical mounting, the projection of the lower axis of rotation 84 onto a horizontal plane, for example, support plate 30 (FIG. 1), would be approximately collinear. Further, the parallel lower and upper axes of rotation 84, 86 would define a substantially vertical plane that is substantially perpendicular to the support plate 30. Therefore, the opposed and contacting cutting portions 88 (FIG. 3) and 90 (FIG. 2) of the respective upper and lower slitting wheels 42, 64 are substantially parallel, and the cutting portions 88, 90 have a small common area of contact.

However, in contrast to a typical mounting described above, with the present invention, as shown in FIG. 4, the inner bearing 80 is offset in a substantially horizontal plane in the direction indicated by the arrow 90, thereby making the lower spindle 62 and corresponding lower axis of rotation 84 oblique to the upper spindle 44 and corresponding upper axis of rotation 86. In other words, the lower spindle 62 and corresponding lower axis or rotation 84 is pivoted in a plane parallel to the support plate 30 with respect to the upper spindle 44 and corresponding upper axis of rotation 86 through an angular displacement 91 of about 2°. Thus, projections of the lower and upper axes of rotation 84, 86 into the plane of the support plate 30 form an included angle 91 between the projected lower and upper axes of rotation 84, 86 of about 2°. This small pivoting of the spindle 62, its corresponding axis of rotation 84 and lower slitting wheel 64 angles or skews the lower slitting wheel 64 with respect to the upper slitting wheel 42. Thus, the cutting portions 88, 90 are not parallel, and the area of common contact between the cutting portions 88, 90 is substantially reduced.

Referring to FIG. 2, the upper spindle 44 has a central axial bore 92 that contains a compression spring 94. The biasing compression spring 94 mechanically contacts an end 96 of an adjusting screw 98 that is threaded into a nut 99 that is mounted or secured in a wall of the gear box 66. Alternatively, the adjusting screw 98 can supported in a threaded hole in the wall of the gear box 66. The spindle 44 is axially movable with respect to the gear box 66, and thus, the spring 94 is effective to provide an axial preload or biasing force on the upper spindle 44. That biasing force preloads or pushes the upper slitting wheel 42 against the lower slitting wheel 64. Further, the magnitude of that preload force is adjustable by turning the adjusting screw 98. The application of the axial preload or force on the upper slitting wheel 42 guarantees that the upper cutting portion 88 (FIG. 3) of the upper slitting wheel 42 always remains in contact with the lower cutting portion 90 (FIG. 2) of the lower slitting wheel 64. Thus, the axial preload on the upper slitting wheel 42 substantially improves the cutting action of the upper and lower slitting wheels 42, 64. Further, the net effect of the axial preload provided by the biasing spring 94 combined with the small angular pivot of the lower spindle 62 and slitting wheel 64 is to provide a dynamic and automatic self-sharpening of the cutting portions 88, 90 of the respective upper and lower slitting wheels 42, 64.

Referring to FIGS. 1 and 3, the conveyor 28 is comprised of an upper conveyor 100 and a lower conveyor 102. The upper conveyor is powered from a drive shaft 104 that is mounted to the upper slitting wheel 42 by means of a flange 106 extending from one end of the upper drive shaft 104. A drive pulley 108 is mounted on and connected to the upper drive shaft 104. The drive pulley 108 engages an upper conveyor belt 110 that is further supported by a fixed idler pulley 112 and pairs of inner and outer movable idler pulleys 114, 116. The idler pulley 112 has a fixed axle 118 that is supported by L-bracket 120 (FIG. 1) mounted to the extrusion 72, and the movable idler pulleys 114, 116 are supported by respective axles 128, 130.

An outer four bar linkage or mechanism 122 is mounted on outer ends of the drive spindle 104 and axles 118, 128, 130. The four bar linkage 122 includes an upper fixed link 124 connected at its ends to the upper conveyor drive shaft 104 and the fixed axle 118. A lower movable link 126 is substantially parallel to the upper link 124 and pivotally connected at its ends to axles 128, 130 supporting the respective idler pulleys 114, 116. The four bar linkage 122 further comprises a pair of parallel pivot links 132, 134. The first pivot link 132 is pivotally connected at one end to the axle 118 and pivotally connected at an opposite end to the axle 128. The second pivot link 134 is pivotally connected at one end to the upper drive shaft 104 and pivotally connected at its opposite between the idler pulleys 114, 116 is displaceable in a generally vertical direction depending on the thickness of the stack of soft goods passing between the upper and lower conveyors 100, 102. Referring to FIG. 3, an inner four bar linkage **122*a* is mounted on inner ends of the drive spindle 104 and axles 118, 128, 130. The inner four bar linkage 122*a* is identical in construction to the outer four bar linkage 122 described above, except that the inner four bar linkage does not require a link comparable to the fixed link 122**.

The outer four bar linkage 122 includes a compression force biasing adjustment. A compression spring 136 is mounted over an adjusting screw 138 that, in turn, is threaded into the first pivot link 132. Thus, by turning the adjusting screw 138, the compression force applied by the upper conveyor 100 against a stack of soft goods moving thereunder can be adjusted. In other words, tightening or shortening the effective length of the compression spring 138 provides a greater preloading or biasing force that resists an upward movement of the lower movable link 126 and the pivot links 132, 134. Hence, a greater downward acting compression force is applied against a stack of soft goods moving between the upper and lower conveyors 100, 102, thereby compressing the stack of soft goods to a lesser height or thickness.

As shown in FIG. 3, the lower conveyor 102 has a lower conveyor drive pulley 140 mounted on the axle 57 that also rotates with the pinion gear 54 (FIG. 2) and sprocket 56 of the drive train for the slitter 24. The lower conveyor drive pulley 140 drivingly engages a lower conveyor belt 142 (FIG. 1) that is also supported by pairs of inner and outer idler pulleys 144, 146, 148 (FIG. 3). The idler pulleys 144, 146, 148 are rotatably supported by respective axles 150, 152, 154. Inner ends of the axles 150, 152, 154 are supported by the inner shaft support 68; and the outer ends of the axles 150, 152, 154 are supported by an outer shaft support 69 (FIG. 1). Thus, the lower conveyor belt 142 provides a fixed, generally horizontal surface that is substantially parallel to the surface of the support plate 30. The inner and outer shaft supports 68, 69 are rigidly connected together by tie bars (not shown) that are fastened at their ends to the shaft supports.

With the above-described structure, the motor 24 is operative to power not only the upper and lower slitting wheels 42, 64, but also the upper and lower conveyors 100, 102. Further, the drive pulleys 108, 140 have diameters relative to the diameters of the upper and lower slitting wheels 42, 64 such that the linear velocities of the respective upper and lower conveyor belts 110, 142 are substantially equal. Further, the linear velocity of the conveyor belts 110, 142 is substantially less than the linear velocities of the outer circumferences of the respective upper and lower slitting wheels 42, 64.

Figure 5:
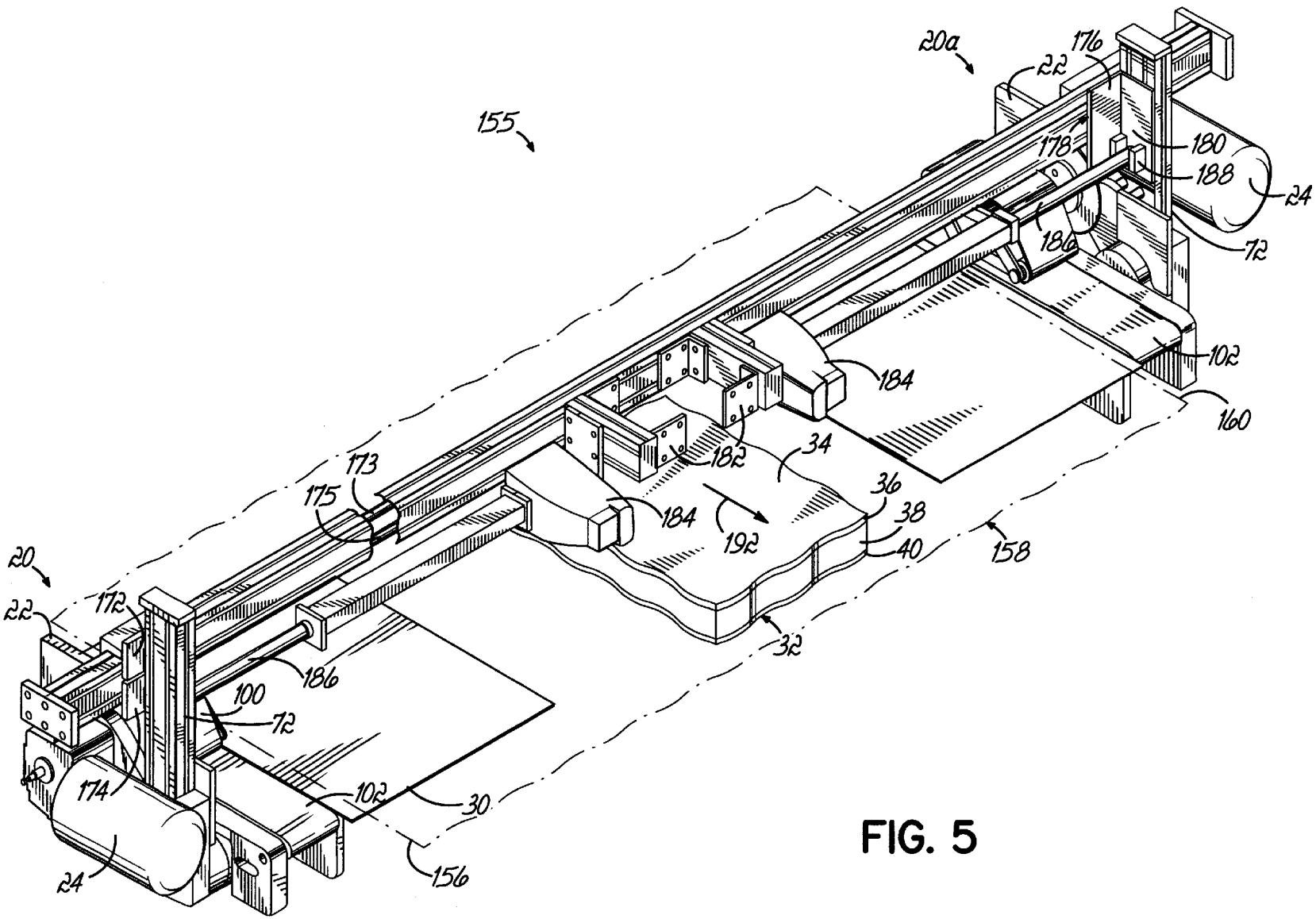
FIG. 5 is a partial perspective view of a machine that uses the slitter and feed mechanisms of FIGS. 1 and 3.

In use, referring to FIG. 5, a machine 155 for trimming the side edges of soft goods has a first slitter and feed mechanism 20 mounted adjacent one edge 156 of a stationary table 158. A second slitter and feed mechanism 20*a* is mounted adjacent an opposite edge 160 of the stationary table 158. The slitter and feed mechanisms 20, 20*a* are mirror images of each other. Further, the extrusions 72 as well as the other parts of the support frames 22 are identical parts that are fabricated so that they may be used with either of the slitter and feed mechanisms 20, 20*a*. In addition, all of the other parts in the slitter and feed mechanisms 20, 20*a* are identical and interchangeable. Thus, the assembly of different, that is, mirror image, slitter and feed mechanisms 20, 20*a* is relatively cost efficient.

The extrusions 72 are supported by a cross rail 170 that is rigidly supported at its ends by structure (not shown). The rail 170 is an aluminum extrusion that contains upper and lower parallel linear guides 172, 174, respectively, that are mounted on respective linear bearings 173, 175 within the rail 170. The rail 170 and linear guides and bearings are commercially available as a unit from 80/20, Inc. of Columbia, Ind. Both of the linear guides 172, 174 are rigidly fastened to one leg 176 of an L-bracket 178. The other leg 180 of the L-bracket 178 is rigidly fastened to the extrusion 22. A pair of actuator mounts 182 are rigidly fastened to the rail 170. Each of the actuator mounts 182 supports an actuator 184 that is operable to reciprocate, that is, extend and retract, a drive shaft 186. A distal end of each of the drive shafts 186 is pivotally connected to the leg 180 of the L-bracket 178 via pivot blocks 188. The actuators 184 may be any appropriate actuator that is effective to move the slitter and feed mechanisms 20, 20*a* longitudinally with respect to the rail 170, for example, a cylinder, a motor driven screw, etc. Thus, the actuators 184 are operable to control the separation between the slitter and feed mechanisms 20, 20*a* on the rail 170. The actuators 184 can be operated to position the slitter and feed mechanisms 20, 20*a* at different locations on the rail 170 to accommodate different widths of the soft goods being trimmed. The width of the soft goods also corresponds to the width of the stationary table 158. The stationary table 158 is located on top of the support plates 30 of the slitter and feed mechanisms 20, 20*a*.

The slitter and feed mechanisms 20, 20*a* are used to cut opposed side edges of a stack of soft goods, a portion of which is shown at 32. As will be appreciated, the stack of soft goods 32 is supported on an upper surface 190 of the table 158 and normally extends substantially the full distance between the extrusions 72. In this example, the stack of soft goods is a mattress cover comprising a top layer 34 of a ticking fabric material, a lower layer 36 of a fiber material, a third layer 38 of a foam and a bottom layer 40 of a fabric backing material. More or fewer layers of soft goods may be utilized depending on the application of the stack of soft goods 32. The mattress cover is about 2–6 inches thick. In this application, the slitting wheels 42, 64 are mounted such that the cutting portion 88 (FIG. 3) on the upper wheel 42 contacts the cutting portion 90 (FIG. 2) on the lower wheel 64 about 0.75 inches above the support plate 30.

Figure 6:
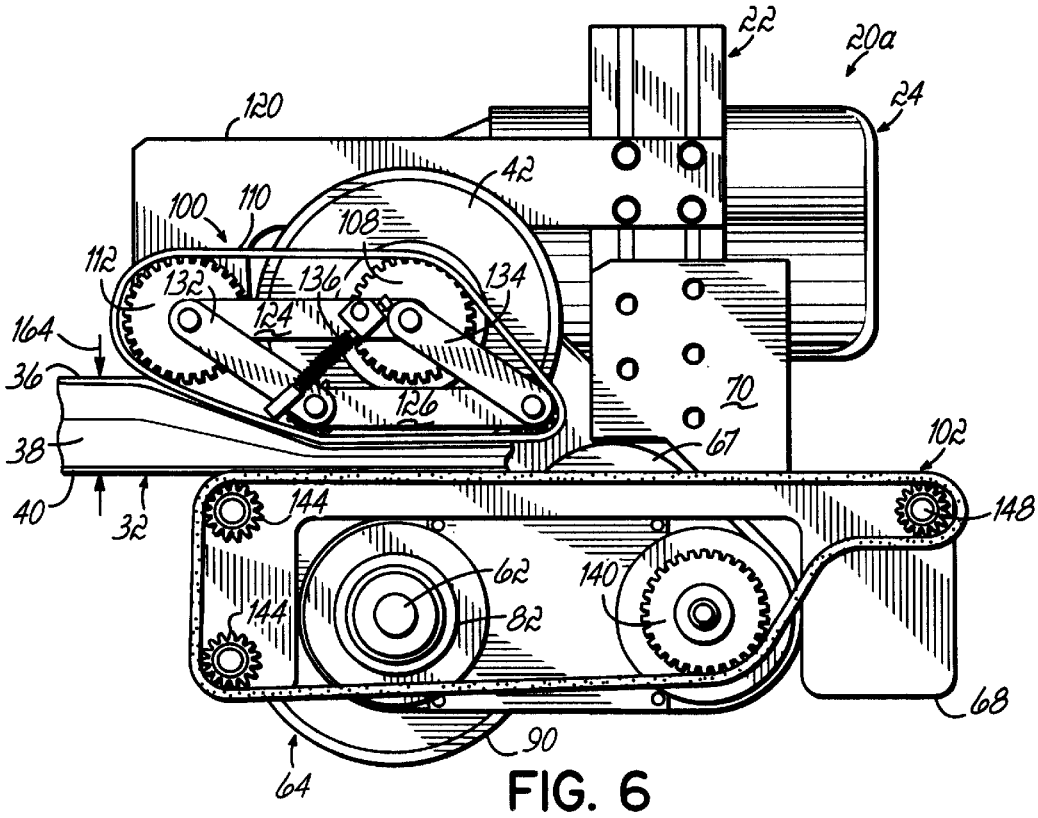
FIG. 6 is a front elevation view of the slitter and feed mechanism of FIG. 3 illustrating a resilient deflection of an upper conveyor as soft goods are fed thereby.

As the mattress cover 32 is fed by an upstream conveyor (not shown) onto the stationary table 158, its lateral edges are engaged by the upper and lower conveyors 100, 102 on each of the slitter and feed mechanisms 20, 20*a* and the mattress cover 32 is fed over the table 158 in a direction indicated by the arrow 192. Referring to FIG. 6, the upper conveyor 100 is moving in a counterclockwise direction, and the conveyor 102 is moving in a clockwise direction. The uncompressed thickness 164 may be five or more inches. As the stack of soft goods 32 is fed between the conveyors 100, 102, the upper conveyor 100 applies a compression force against the top of the stack of soft goods 32. As the stack of soft goods 32 force the lower link 132 and the pivot links 132, 134 upward, the compression spring 136 compresses and shortens, thereby increasing the compression force as a function of the spring constant of the spring 136. The compression force is able to reduce the thickness of the stack of soft goods 32 to about two or more inches as the stack of soft goods is conveyed between the upper and lower conveyors 100, 102. Referring to FIG. 5, as the side edges of the mattress cover 32 is compressed and conveyed by the respective conveyors 100, 102 of respective slitter and feed mechanisms 20, 20*a*, the edges pass between respective upper and lower slitting wheels 42, 64 that trim the edges to desired straight edges separated by a desired width.

The slitter and feed mechanism 20 is a relatively compact and inexpensive device for reliably compressing and cutting side edges of a stack of soft goods, for example, a mattress cover. The slitter and feed mechanism 20 utilizes a single motor 22 to drive both of the slitting wheels 42, 64 as well as both of the conveyors 100, 102. The utilization of a single motor to achieve conveying, compressing and cutting functions represents a substantial cost savings. The upper conveyor 100 includes an adjustable biasing device 136, 138 that readily permits the compression force to be easily adjusted as required by different stacks of soft goods. In addition, the upper slitting wheel 42 has a biasing device 94, 98 that preloads the cutting portion 88 of the upper slitting wheel 42 against the cutting edge 90 of the lower slitting wheel 64. This preload more reliably maintains contact between the cutting portions 88, 90 such that a clean and consistent cutting action is provided. In addition, the outer bearing 78 is slightly offset with respect to the inner bearing 80. Therefore, the spindle 62 and the lower slitting wheel 64 is slightly oblique with respect to the spindle 44 of the upper slitting wheel 42. This oblique orientation of the respective slitting wheels 42, 64 together with the axial preload on the slitting wheels 42, 64 promotes a self-sharpening of the cutting portions 88, 90, thereby providing a more reliable cutting action over an extended period of time.

The features described above can be incorporated into a panel cutter for a quilting machine, which is situated either in a separate cutting line or in-line with and downstream of a quilting machine. Such a quilting machine typically produces quilted mattress covers from a multi-layered web of material that forms the soft goods described above and illustrated in the figures. The panel cutter operates to transversely sever and crop panels from the web using transverse cutter tools provided for this purpose. In addition, slitters are provided in the panel cutter to trim selvedge edges from the quilted web or from individual quilted panels. While the features are described above as applied to slitters or longitudinal trimmers, these features can also be adapted for use in performing the transverse cut-off functions of the panel cutters, as most of the problems and properties found in slitting or trimming the edges of the quilted soft goods also can be found in cut-off operations performed on the same material.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the biasing means 94, 136 are compression springs. As will be appreciated, other mechanisms can be utilized to create a downward acting compression force with the upper conveyor 100 or an axial preload force on the upper slitting wheel 42. Further, in the described embodiment, the slitting wheel 42 is biased against the slitting wheel 64; however, as will appreciated, in another embodiment, the slitting wheel 64 can be biased against the slitting wheel 42.

Therefore, the invention in its broadest aspects is not limited to the specific details shown and described. Consequently, departures may be made from the details described herein without departing from the spirit and scope of the claims which follow.

What is claimed is:

1. An apparatus for feeding and slitting soft goods being supported on an upper surface of a table comprising:

a frame adapted to be mounted adjacent one side of the table;

a motor mounted on the frame;

a first slitting wheel;

a spindle having an internal bore and a distal end connected to the first slitting wheel and a proximal end connected to, and mounted to rotate with, the motor;

a second slitting wheel rotatably supported by the frame, the second slitting wheel contacting the first slitting wheel to provide a cutting action; and a compression spring mounted in the internal bore and mechanically connected to the spindle, the compression spring applying a biasing force on the spindle to push the first slitting wheel against the second slitting wheel with a desired biasing force.

2. The apparatus of claim 1 wherein the biasing apparatus further comprises an adjusting knob contacting one end of the compression spring, the biasing force being changeable by using the adjusting knob to change a length of the compression spring.

3. The apparatus of claim 2 wherein the motor has a housing and the adjusting knob is threaded in the housing.

4. The apparatus of claim 1 wherein the first slitting wheel rotates with respect to a first axis of rotation adapted to be substantially parallel to the upper surface of the table, and the second slitting wheel rotates with respect to a second axis of rotation adapted to be substantially parallel to the upper surface of the table, the second axis of rotation being oblique to the first axis of rotation.

5. The apparatus of claim 4 wherein the second axis of rotation is pivoted with the first axis of rotation in a plane parallel to the upper surface of the table.

6. The apparatus of claim 5 wherein projections of the first axis of rotation and the second axis of rotation onto the upper surface of the table are nonparallel and noncoincident.

7. The apparatus of claim 6 wherein projections of the first axis of rotation and the second axis of rotation onto the upper surface of the table form an acute angle therebetween.

8. The apparatus of claim 7 wherein the acute angle has a magnitude causing the peripheral edge of the second powered slitting wheel to sharpen the peripheral edge of the first powered slitting wheel.

9. The apparatus of claim 8 wherein the acute angle is about 20°.

10. An apparatus for feeding and slitting soft goods being supported on an upper surface of a table comprising:

a frame adapted to be mounted adjacent one side of the table;

a first slitting wheel;

a powered first spindle connected to the first slitting wheel and rotatably supported by the frame to define a first axis of rotation adapted to be substantially parallel to the upper surface of the table;

a second slitting wheel contacting the first slitting wheel to provide a cutting action;

a powered second spindle connected to the second slitting wheel and rotatably supported by the frame to define a second axis of rotation adapted to be substantially parallel to the upper surface of the table, a first bearing mounted on the frame;

a second bearing spaced apart from the first bearing, the first bearing and the second bearing supporting the first spindle to make the first axis of rotation substantially oblique to the second axis of rotation; and a biasing apparatus mechanically connected to one of the first and the second spindles and applying a biasing force on the one of the first and the second spindles to axially preload the one of the first and the second slitting wheels against another of the first and the second slitting wheels.

11. The apparatus of claim 10 wherein the second bearing is displaced from the first axis of rotation in a plane substantially parallel to the upper surface of the table.

12. An apparatus for feeding and slitting a stack of compressible soft goods being supported on an upper surface of a table comprising:

a frame adapted to be mounted adjacent one side of the table;

a first powered slitting wheel rotatably supported by the frame;

a second powered slitting wheel rotatably supported by the frame and contacting the first slitting wheel to provide a cutting action;

a powered lower conveyor adapted to be positioned adjacent the table and comprising a lower conveyor belt adapted to contact and support a lower surface along an edge of the soft goods; and a powered upper conveyor disposed above the lower conveyor and adapted to contact an upper surface along the edge of the soft goods, the upper conveyor comprising an upper conveyor belt having a belt portion resiliently movable in a generally vertical direction with respect to the lower conveyor.

13. The apparatus of claim 12 wherein the upper conveyor further comprises:

a powered drive pulley and a plurality of idler pulleys, the drive pulley and the idler pulleys supporting the upper conveyor belt; and a mechanism supporting the drive pulley and the idler pulleys, the mechanism having a fixed portion supporting one of the pulleys and a resiliently movable portion supporting others of the pulleys.

14. The apparatus of claim 12 wherein the mechanism further comprises a four bar linkage.

15. The apparatus of claim 14 wherein the four bar linkage further comprises:

a fixed link having opposed ends;

a pair of pivot links, each pivot link of the pair of pivot links having one end pivotally connected to a different end of the fixed link; and a movable link having opposed ends, and each end of the movable link being connected to an opposite end of a different one of the pair of pivot links.

16. The apparatus of claim 12 further comprising a motor supported by the frame and mechanically connected to the first and second slitting wheels and the lower and upper conveyors.

17. An apparatus for feeding and slitting soft goods being supported on a table comprising:

a frame adapted to be mounted adjacent one side of the table;

a motor mounted on the frame;

a first slitting wheel powered by the motor and rotatably supported by the frame;

a second slitting wheel powered by the motor and rotatably supported by the frame and contacting the first slitting wheel to provide a cutting action;

a lower conveyor powered by the motor and supported by the frame, the lower conveyor adapted to be positioned adjacent the table and comprising a lower conveyor belt adapted to contact and support a lower surface along an edge of the soft goods; and an upper conveyor powered by the motor and supported by the frame above the lower conveyor, the upper conveyor adapted to contact an upper surface along the edge of the soft goods, the upper conveyor comprising an upper conveyor belt having a belt portion resiliently movable in a generally vertical direction with respect to the lower conveyor.

18. The apparatus of claim 17 further comprising:

a biasing apparatus mechanically connected to the spindle and applying a biasing force on the spindle to push the first slitting wheel against the second slitting wheel with a desired biasing force;

a first axis of rotation defined by a rotation of the first slitting and adapted to be substantially parallel to the upper surface of the table; and a second axis of rotation defined by a rotation of the second slitting wheel and adapted to be substantially parallel to the upper surface of the table, the second axis of rotation being oblique to the first axis of rotation.

19. An apparatus for feeding and slitting compressible soft goods comprising:

a stationary table having an upper surface adapted to support the soft goods;

a rail mounted above the stationary table and extending across a width of the stationary table;

a first slitter and feed mechanism mounted for sliding motion adjacent one end of the rail;

a first actuator supported by the rail having a reciprocable drive shaft pivotally connected to the first slitter and feed mechanism;

a second slitter and feed mechanism mounted for sliding motion adjacent an opposite end of the rail;

a second actuator supported by the rail and having a reciprocable drive shaft pivotally connected to the second slitter and feed mechanism, the first and second actuators being operable to move respective first and second slitter and feed mechanisms to different positions along the rail.

20. The apparatus of claim 19 wherein the rail further comprises:

a first linear bearing and a first linear guide supported for linear motion on the first linear bearing, the first linear guide supporting the first slitter and feed mechanism; and a second linear bearing and a second linear guide supported for linear motion on the second linear bearing, the second linear guide supporting the second slitter and feed mechanism.

21. A method of making quilted panels comprising:

quilting multi-layered soft goods at a quilting station;

feeding the quilted soft goods to a cutting apparatus;

at the cutting apparatus, supporting the quilted soft goods on a table having a frame, a motor mounted on the frame, a first slitting wheel powered by the motor and rotatably supported by the frame, a second slitting wheel powered by the motor and rotatably supported by the frame and contacting the first slitting wheel to provide a cutting action, a lower conveyor powered by the motor and supported by the frame, the lower conveyor adapted to be positioned adjacent the table and comprising a lower conveyor belt adapted to contact and support a lower surface along an edge of the soft goods; and an upper conveyor powered by the motor and supported by frame above the lower conveyor, the upper conveyor adapted to contact an upper surface along the edge of the soft goods, the upper conveyor comprising an upper conveyor belt having a belt portion resiliently movable in a generally vertical direction with respect to the lower conveyor; and energizing the motor to operate the cutting apparatus to feed the quilted soft goods through over the table and to slit the opposite edges from the quilted soft goods.

* * * * *

UNITED STATES PATENT AND TRADEMARK OFFICE

CERTIFICATE OF CORRECTION

PATENT NO. : 6,736,078 B2
DATED : May 18, 2004
INVENTOR(S) : Kaetterhenry et al.

It is certified that error appears in the above-identified patent and that said Letters Patent is hereby corrected as shown below:

Column 1,
Line 11, reads "...in large-scale, wide-width quilt manufacturer." and should read -- … in large-scale, wide-width quilt manufacture. --

Column 3,
Lines 61-63, reads "...shown in FIG. 1. and which is used to trim an opposite edge of the soft goods. For a slitter and feed mechanism" and should read -- ...shown in Fig. 1 and which is used to trim an opposite edge of the soft goods for a slitter and feed mechanism. --.
Lines 64-65, reads "…is a top view of… and illustrate an oblique…" and should read -- ...is a top view of… and illustrates an… --.

Column 4,
Line 58, reads "...fastened to the to the outer shaft support 69." and should read -- ...fastened to the outer shaft support 69. --.

Column 5,
Line 41, reads "...screw 98 can supported in a threaded hole in…" and should read --...screw 98 can be supported in a threaded hole in… --.

Column 6,
Line 20, reads "...connected at its opposite...between the idler pulleys" and should read -- connected at its opposite end to the axle 130. Thus, the portion of the conveyor belt 110 (FIG. 1) passing between the idler pulleys… --.

Column 7,
Line 30, reads "A pair of actuator mounts 182 are…" and should read -- A pair of actuator mounts 182 is… --.
Line 63, reads "...about 0.75 inches above…" and should read -- ...about 0.75 inch above… --.

Column 8,
Line 17, reads "...side edges of the...is compressed and…" and should read -- ...side edges of the..are compressed and… --.

UNITED STATES PATENT AND TRADEMARK OFFICE

CERTIFICATE OF CORRECTION

PATENT NO. : 6,736,078 B2
DATED : May 18, 2004
INVENTOR(S) : Kaetterhenry et al.

It is certified that error appears in the above-identified patent and that said Letters Patent is hereby corrected as shown below:

Column 9,
Lines 1-2, reads "...no intention to restrict nor in any way limit…" and should read -- ...no intention to restrict or in any way limit… --.
Lines 11-12, reads "...as will appreciated, in another embodiment…" and should read --...as will be appreciated, in another embodiment… --.
Lines 64-65, "...acute angle is about 20º." and should read -- ...acute is about 2º. --.

Column 11,
Lines 35-36, reads "...rotation of the first slitting and adapted to.." and should read -- ...rotation of the first slitting wheel and adapted to… --.

Column 12,
Line 47, reads "...soft goods through over the table and…" and should read -- ...soft goods over the table and… --.

Signed and Sealed this

Fourteenth Day of December, 2004

JON W. DUDAS
*Director of the United States Patent and Trademark Office*